US007703602B2

(12) United States Patent
Saito et al.

(10) Patent No.: US 7,703,602 B2
(45) Date of Patent: Apr. 27, 2010

(54) EASY-OPEN ENCASEMENT

(75) Inventors: Ikuya Saito, Kagawa (JP); Takeshi Hanajiri, Kagawa (JP); Takeshi Bando, Kagawa (JP); Hiromi Yamada, Kagawa (JP)

(73) Assignee: Uni-Charm Corporation, Ehime-Ken (JP)

( * ) Notice: Subject to any disclaimer, the term of this patent is extended or adjusted under 35 U.S.C. 154(b) by 549 days.

(21) Appl. No.: 11/552,616

(22) Filed: Oct. 25, 2006

(65) Prior Publication Data

US 2007/0095709 A1 May 3, 2007

(30) Foreign Application Priority Data

Oct. 31, 2005 (JP) ..... 2005-317362

(51) Int. Cl.
*B65D 73/00* (2006.01)

(52) U.S. Cl. ..... 206/210; 206/494

(58) Field of Classification Search ..... 206/210, 206/494, 233, 812; 383/66, 203, 207, 208
See application file for complete search history.

(56) References Cited

U.S. PATENT DOCUMENTS

| | | | | |
|---|---|---|---|---|
| 3,982,685 | A * | 9/1976 | Shimada | 229/207 |
| 4,458,810 | A * | 7/1984 | Mahoney | 206/210 |
| 4,863,064 | A * | 9/1989 | Dailey, III | 221/48 |
| 5,035,518 | A | 7/1991 | McClintock | |
| 5,582,294 | A * | 12/1996 | Yamada | 206/494 |
| 5,996,797 | A * | 12/1999 | Flaig | 206/494 |
| 6,026,953 | A * | 2/2000 | Nakamura et al. | 206/233 |
| 6,113,271 | A * | 9/2000 | Scott et al. | 383/211 |
| 2002/0017522 | A1* | 2/2002 | Bando et al. | 220/254 |
| 2005/0284776 | A1* | 12/2005 | Kobayashi et al. | 206/210 |

FOREIGN PATENT DOCUMENTS

| | | |
|---|---|---|
| EP | 1466843 | 10/2004 |
| EP | 1468936 | 10/2004 |
| JP | S59-99974 | 7/1984 |
| JP | 9142551 | 6/1997 |
| JP | 10-017037 | 1/1998 |
| JP | 10-053286 | 2/1998 |
| JP | 10-167355 | 6/1998 |
| JP | 11-020874 | 1/1999 |
| JP | 11-268783 | 10/1999 |

(Continued)

*Primary Examiner*—Jacob K Ackun, Jr.
*Assistant Examiner*—King M Chu
(74) *Attorney, Agent, or Firm*—Lowe Hauptman Ham & Berner

(57) ABSTRACT

An easy-open encasement formed of a soft encasement member in the form of a film. An opening or an openable portion is formed in the soft encasement member, which allows a user to extract contents from the encasement. Furthermore, a lid member, which can be peelably adhered to the soft encasement member, is adhered to the surface of the soft encasement member such that it covers the opening or openable portion. With such a structure, a tab is provided at a part of the perimeter of the lid member, which serves as a starting point that allows the user to peel off the lid member. Furthermore, the tab includes a hinge portion, which allows the user to raise the tab, or a flap elevated from the surface of the encasement.

16 Claims, 12 Drawing Sheets

FOREIGN PATENT DOCUMENTS

| | | |
|---|---|---|
| JP | 11-310281 | 11/1999 |
| JP | 11-314686 | 11/1999 |
| JP | 2000-000177 | 1/2000 |
| JP | 2001-525300 | 11/2001 |
| WO | 99/29589 | 6/1999 |

* cited by examiner

EASY-OPEN ENCASEMENT

This application is based on and claims the benefit of priority from Japanese Patent Application No. 2005-317362, filed on Oct. 31, 2005, the content of which is incorporated herein by reference.

BACKGROUND OF THE INVENTION

1. Field of the Invention

The present invention relates to an encasement for storing various kinds of contents such as wet tissues, and more specifically, relates to a resealable opening mechanism of a lid member for openably sealing an opening of an encasement.

2. Related Art

Regarding soft encasements for storing contents containing moisture such as wet tissues, soft encasements are being studied. Such soft encasements are easy to carry, it is easy to extract the contents therefrom, and they are resealable so as to prevent drying of the wet tissues remaining therein for reuse.

Examples of such soft encasements commercially available include a soft encasement having a structure in which an adhesive label is adhered over a slit tear line formed on the soft encasement. Such an arrangement allows the user to peel the label so as to tear open a part of the soft encasement member with the end of the slit tear line as a starting point, thereby allowing an opening to be formed at the time of use. The soft encasement may be used in combination with an airtight outer container formed of polypropylene resin or the like, for example. Such an arrangement further improves the capability of preventing drying of the contents stored in the soft encasement.

Specifically, Japanese Unexamined Utility Model Registration Application Publication No. 59-99974 (herein after Patent document 1) discloses a sealing bag for storing contents such as wet tissues, which is formed of a fiber material for cosmetics, and which has a structure that allows the opening of the sealing bag to be repeatedly opened and sealed. More specifically, the sealing bag has a structure in which a slit is formed in a main bag member so as to form an opening, and a lid is peelably provided on the main bag member by an adhesive agent, thereby providing a film soft encasement having an opening which allows the user to reseal the film soft encasement.

Also, PCT Japanese Translation Patent Publication No. 2001-525300 (herein after Patent document 2) discloses a casing for wet tissues or the like, which has the same advantage of allowing the user to repeatedly adhere/peel a lid to/from the casing over multiple cycles without deterioration in the airtightness of the casing. Specifically, the casing has a structure in which a slit is formed in an encasement member such that it allows an opening to be formed by peeling off a single label. With such an arrangement, the single label is provided so as to cover the entire area of the opening. The encasements disclosed in the aforementioned Patent documents 1 and 2 each allow the user to reseal the encasement with the label. Such arrangements allow the user to seal the encasement with high airtightness after use by properly applying the label to the encasement.

Also, Japanese Unexamined Patent Application Publication No. 11-310281 (hereinafter the Patent document 3) discloses an encasement having a structure in which a lid member is provided such that it covers an opening for extraction of the contents of the encasement in a manner that allows the user to open/close the opening. The lid member of the encasement has a portion at one of its ends, which serves as a tab that can be pulled by the user using the fingers. Such an arrangement greatly improves the ease-of-use, which allows the user to easily open the opening at the time of use.

DISCLOSURE OF INVENTION

Problems to be Solved by the Invention

The encasement for wet tissues needs to have a capability of preventing the moisture from escaping from the wet tissues, and a capability of remaining airtight for a predetermined number of instances of the opening/closing operation of the lid member. This requires relatively strong adhesiveness between the lid member and the encasement. Furthermore, the label member needs to have a capability that allows it to be repeatedly and peelably adhered by the user to the encasement without it becoming wrinkled, and a capability of serving to a certain degree as a barrier against the moisture. Accordingly, the encasements disclosed in the Patent document 1 and 2 have a structure in which the end of the label which serves as a tab that can be pulled by the user is also pressed into contact with the encasement film. Accordingly, the gap between the film and the tab of the label is slight (practically zero), leading to the problem of it being very difficult for the user to open the label.

In particular, let us consider an arrangement in which the non-adhesive portion has a length (the tab has a short length). Such an arrangement provides the tab of the label with a marked tendency to be pressed in contact with the film due to the rigidity of the label. This hinders the development of a compact product formed of a combination of an encasement with a small label and an outer container as described above.

On the other hand, the encasement disclosed in the Patent document 3 needs to have a label with a larger area than that of another arrangement having no tab structure that can be pulled by the user using the fingers. Furthermore, such a tab structure needs to be formed with sufficient strength to prevent it from tearing, giving consideration to a situation in which, in order to open the encasement, the label is peeled off with a greater force than the adhesive strength. Accordingly, the tab structure needs to be formed of a material having a sufficient thickness and a sufficient rigidity, and with a sufficient length from the end or the perimeter of the label to the "tab portion". This requires excessive costs, and hinders the development of a compact product.

Furthermore, the Patent documents 1 through 3 each disclose an encasement which is to be used in a stand-alone manner. In other words, the Patent documents 1 through 3 provide no ideas for a combination of the encasement and an outer container which is used in the form of a double-encasing structure.

SUMMARY OF THE INVENTION

The present invention has been made in view of the aforementioned problems. Accordingly, it is an object thereof to provide an easy open encasement which has an opening that allows the user to extract the contents, and has a function that allows the user to easily open the encasement by peeling off a lid member so as to form an opening in the encasement. Furthermore, the present invention provides an easy open encasement having a capability that allows it to be resealed by the user. In particular, the present invention provides an easy open encasement which is to be used in combination with an outer container, thereby improving the airtightness.

Means for Solving the Problems

More specifically, the present invention provides easily-openable encasements having the following structures.

In a first aspect of an easy-open encasement of the present invention, an easy-open encasement formed of a soft encasement member in the form of a film includes: an opening or an openable portion formed in the soft encasement member, which allows a user to extract contents from the encasement; a lid member which can be peelably adhered to the soft encasement member, being adhered to a surface of the soft encasement member such that it covers the opening or openable portion; a tab provided at a part of a perimeter of the lid member which serves as a starting point that allows the user to peel off the lid member; and a hinge portion provided to the tab which allows the user to raise the tab.

In a second aspect of an easy-open encasement of the present invention, an easy-open encasement formed of a soft encasement member in the form of a film includes: an opening or an openable portion formed in the soft encasement member, which allows a user to extract contents from the encasement; a lid member which can be peelably adhered to the soft encasement member, being adhered to a surface of the soft encasement member such that it covers the opening or openable portion; a tab provided at a part of a perimeter of the lid member, which serves as a starting point that allows the user to peel off the lid member; and a flap provided with the tab being elevated from the surface of the encasement.

With the easy-open encasement according to the present invention, a hinge portion is provided to the lid member. Such an arrangement allows the user to fold the lid member along the hinge portion. This allows the tab to be raised. Furthermore, such an arrangement allows the user to easily open the encasement by peeling off the lid member with the tab being gripped by the fingers. The tab may be formed of a flap elevated from the encasement. Such an arrangement allows the user to easily open the encasement by peeling off the lid member with the flap being gripped by the fingers.

The term "hinge portion" as used in the present specification is not restricted to a unit having a so-called "hinge structure". Examples of the hinge portions include a center axis along which a soft encasement film member is folded, more specifically, a portion that serves as a center axis along which a film that serves as a lid can be folded and opened.

The term "a part of a perimeter of a lid member" as used in the present specification refers a predetermined region of the edge of a lid member, in which the part of the perimeter has an arc shape and protrudes from a substantially square outline of the lid member. FIGS. 1 and 2 show part of perimeter 214 of the lid member 200.

The term "around a base of a tab" as used in the present specification refers the vicinity around the bottom of the aforementioned tab which protrudes from the substantially square outline of the lid member. The word "around" or "vicinity" refers to the fact that a hinge portion of the present invention is not provided on an exact line at the portion between the substantially square portion of the lid member and the tab portion. The hinge portion is provided such that a tongue portion of the present invention is formed within at least the tab portion.

The term "a part of a perimeter of an exposed opening" as used in the present specification refers to a predetermined region of the edge of an exposed opening in which part of the perimeter curves at one end opposite to a hinge where an outer container and a cap portion are connected. As shown in FIG. 22, at part of the perimeter of the exposed opening 351, a tab 210 of a lid member 200 of an easy-open encasement 100 is in contact with the part of the perimeter of the exposed opening 351 of the outer container 300, allowing the user to pull the tab up easily.

In a third aspect of the easy-open encasement as described in a first aspect of the present invention, the hinge portion is formed of a weak line provided to the lid member in a continuous or discontinuous manner.

In a fourth aspect of the easy-open encasement as described in a third aspect of the present invention, the weak line is provided in the form of a slit tear line, a half-cut line, an embossed line, or a combination thereof.

With such an arrangement, the hinge portion is formed of a weak line. Furthermore, the weak line is preferably provided in the form of a slit tear line alone, a half-cut line alone, an embossed line alone, or various combinations thereof. Such an arrangement allows the soft encasement member to be easily folded along the hinge portion. This allows the user to easily raise the tab.

In a fifth aspect of the easy-open encasement as described in a third aspect of the present invention, the hinge portion is provided around the base of the tab such that it extends along a direction approximately orthogonal to the direction along which the tab is to be raised, and in which the hinge portion includes an approximately U-shaped slit tear line extending opposite to the direction along which the tab is to be raised, and the weak lines which extend from both ends of the approximately U-shaped slit tear line to the respective side edges of the tab.

With such an arrangement, upon folding the tab along the hinge portion, a tongue portion (a lower flap) is formed by virtue of the fully perforated slit line formed in a shape approximately like a letter "U". Let us consider a case in which the tab is completely folded back. In this case, such an arrangement allows the user to open the encasement by peeling off the lid member with the tab being gripped by the fingers. On the other hand, let us consider another case in which the tab is folded to a certain degree. In this case, the tongue portion serves as a support member, which enables the lid member to be maintained in a state in which the tab is elevated from the surface of the encasement. Thus, in this case, such an arrangement allows the user to open the encasement by peeling off the lid member with the tab thus elevated being gripped by the fingers.

In a sixth aspect of the easy-open encasement as described in a third aspect of the present invention, a particular portion around the base of the tab of the lid member is formed with a structure or a thickness that differs from that of the other portion, thereby providing the weak line forming the hinge portion.

With such an arrangement, a particular portion of the soft encasement member is formed with a structure or a thickness that differs from that of the other portion, thereby providing the aforementioned weak line. The hinge portion thus formed allows the lid member to be easily folded. Furthermore, there is a difference in the thickness between the lid member main unit and the tab. This raises or elevates the tab, thereby allowing the user to easily hold the tab.

In a seventh aspect of the easy-open encasement as described in a second aspect of the present invention, a recess is formed on the surface of the encasement, with at least a part of the tab of the lid member being placed at the recess, thereby providing the flap thus elevated.

With such an arrangement, at least a part of the tab is placed at the recess or the gap formed in the face of the encasement, thereby providing a flap. The flap is maintained in a state in which it is elevated from the surface of the encasement. Such an arrangement allows the user to open the encasement by peeling off the lid member with the flap being gripped by the fingers.

In an eighth aspect of the easy-open encasement as described in any one of aspects one through seven of the present invention, the lid member can be reused for resealing after having been peeled off.

Such an arrangement allows the lid member to be resealed after the lid member has been peeled off. Such an arrangement prevents drying of the contents over multiple use cycles. Accordingly, such an arrangement is preferably employed as an encasement for wet tissues.

In a ninth aspect of a double-encasement having a structure in which an easy-open encasement as described in any one of aspects one through eight of the present invention is stored in an outer container, with the outer container includes an exposed opening which enables the lid member of the easy-open encasement to be exposed when it is stored in the outer container, and a cap portion which is provided such that it covers the exposed opening, in a manner that allows the user to open/close the cap portion, and in which the tab of the lid member being placed such that it is exposed from the exposed opening.

With such an arrangement, the encasement according to the present invention is used in combination with an outer container. The cap portion is provided to the outer container, and the lid member is provided to the encasement, thereby maintaining the airtightness of the encasement. Furthermore, the easy-open encasement according to the present invention includes a tab which can be raised, or a flap which is elevated from the encasement. With such an arrangement, the tab is placed such that it is exposed from the exposed opening of the outer container. Such an arrangement provides a double-encasing structure which allows the user to easily peel off the lid member of the encasement while using the encasement in combination with the outer container.

In a tenth aspect of the double-encasement as described in the ninth aspect of the present invention, the tab of the lid member is provided in a manner such that it is raised around the perimeter of the exposed opening.

With such an arrangement, the tab of the lid member is placed around the perimeter of the exposed opening of the outer container. Such an arrangement enables the opening of the encasement to be formed with a large size, thereby providing a double-encasing structure which allows the user to easily extract the contents stored therein.

Advantages

The present invention provides an encasement having a function of allowing the user to easily open the encasement by peeling off the lid member with a tab which can be easily raised along the hinge portion, or a flap provided to the tab, being gripped by the fingers. Also, the present invention provides a double-encasement in the form of a combination of the encasement and the outer container, thereby providing superior airtightness while allowing the user to easily extract the contents.

DETAILED DESCRIPTION OF THE INVENTION

Figure 1:
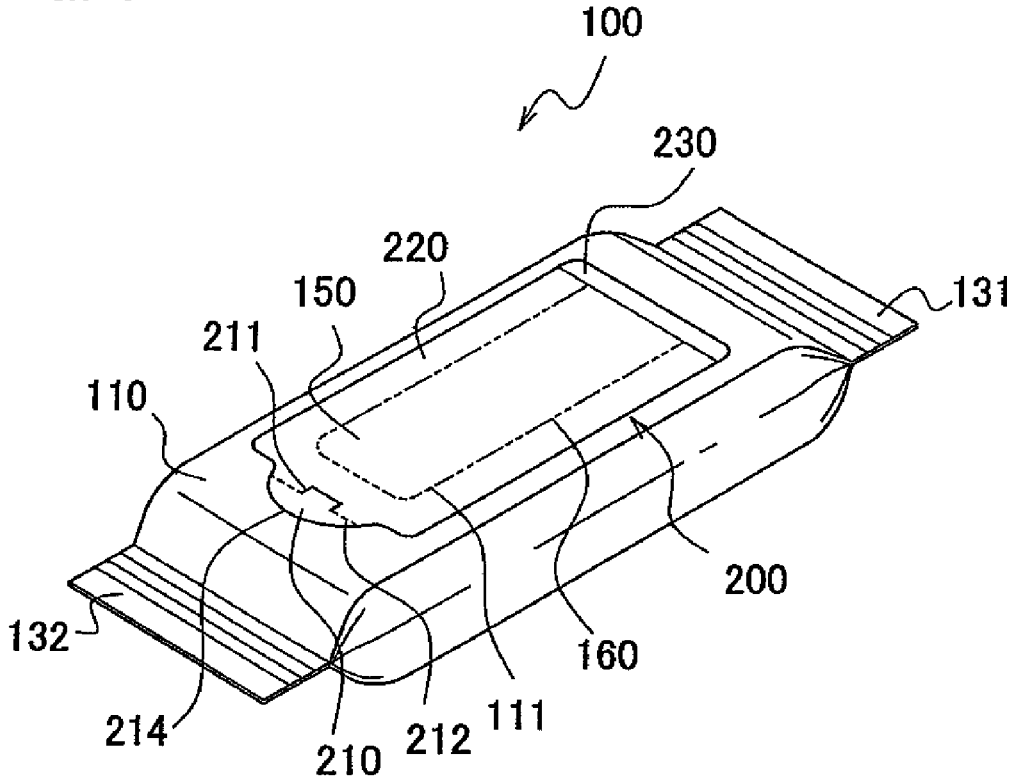
FIG. 1 is a perspective view which shows a schematic structure of an easy-open encasement according to the present invention.

Description will be made below regarding an example of an embodiment according to the present invention with reference to the drawings. Note that, in the following description regarding the embodiments, identical components are denoted by the same reference numerals, and description thereof will be omitted or simplified.

Overall Structure of Easy-Open Encasement

Figure 2:
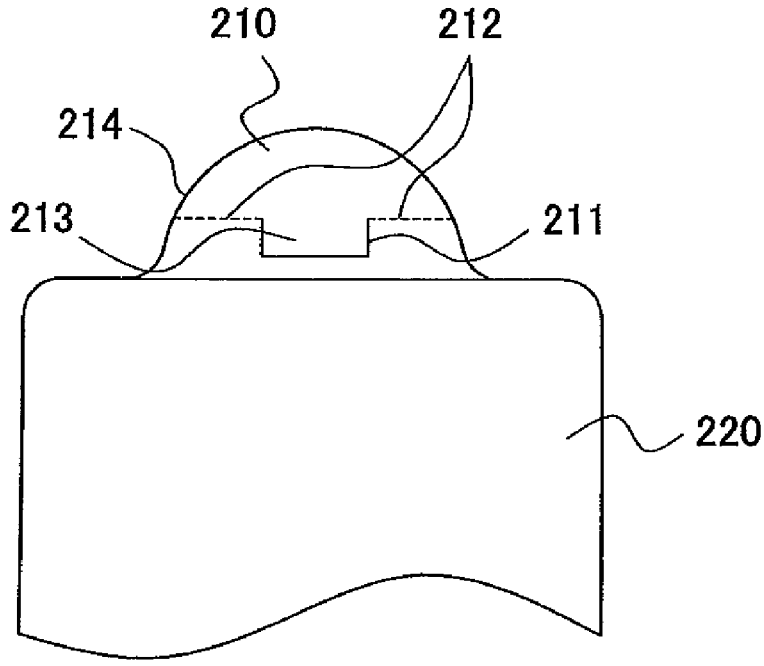
FIG. 2 is an enlarged view which shows a portion around a tab of the lid member shown in FIG. 1.
Figure 3:
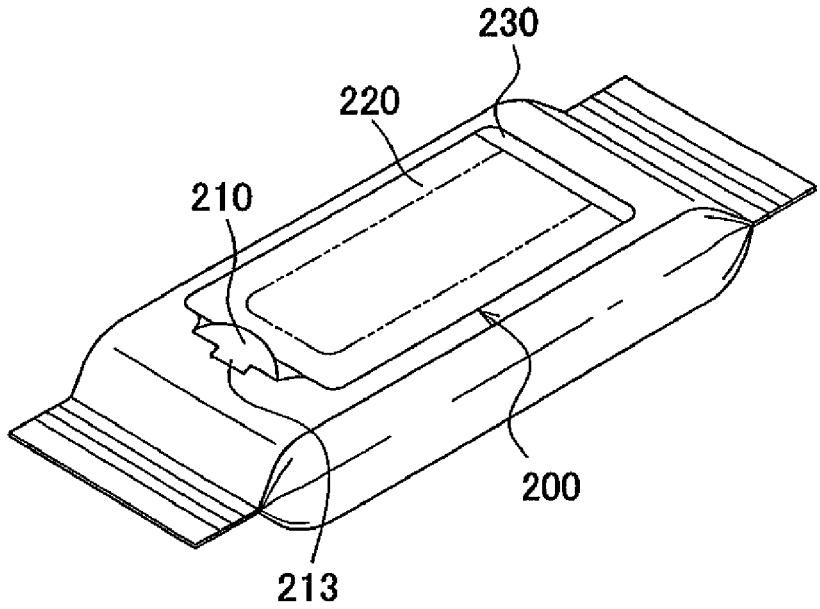
FIG. 3 is a perspective view which shows the easy-open encasement with the tab shown in FIG. 1 having been folded back along a hinge portion.
Figure 4:
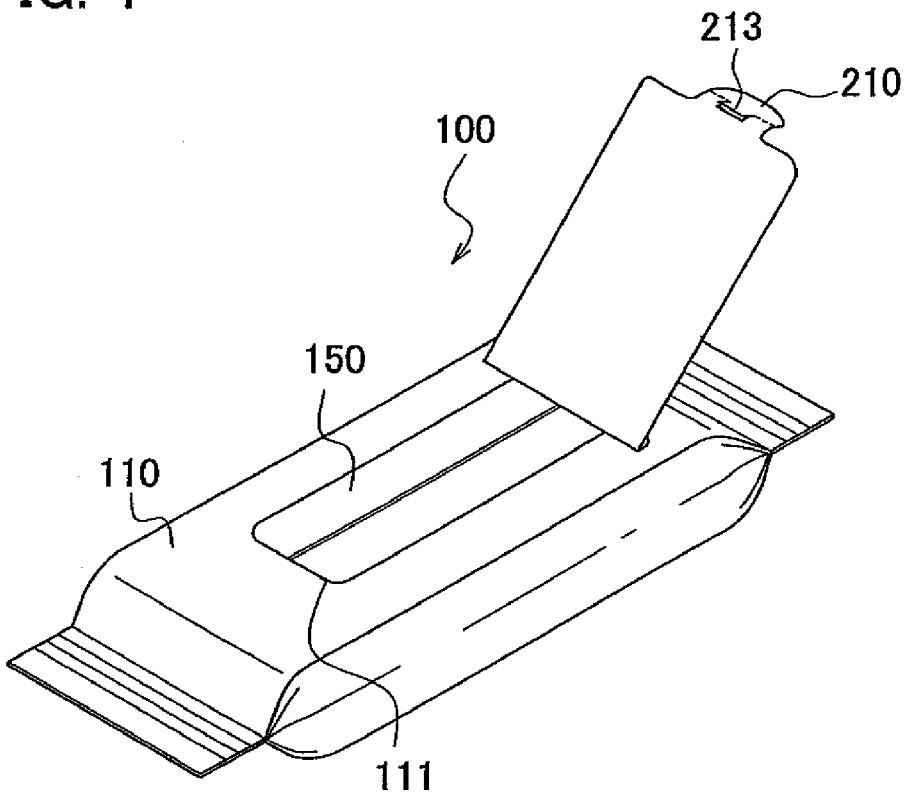
FIG. 4 is a perspective view which shows the easy open encasement having been opened.

FIGS. 1 through 4 are drawings which show an example of an easy-open encasement according to an embodiment of the present invention. In particular, FIG. 1 is a perspective view which shows a schematic structure of the easy-open encasement. FIG. 2 is an enlarged view which shows a portion around a tab (in FIG. 2, an upper flap) 210 of a lid member 200 shown in FIG. 1. FIG. 3 is a perspective view which shows the easy open encasement after the tab 210 shown in FIG. 1 has been folded back along a hinge portion 212. FIG. 4 is a perspective view which shows the easy-open encasement having been opened.

As shown in FIG. 1, an encasement 100 is a pillow-shaped encasement including a film 110 formed of a soft encasement material. FIG. 1 shows the encasement 100 placed on a horizontal plane. As shown in FIG. 1, the encasement 100 has a structure in which a lid member 200 is adhered to the upper face of the film 110. Reference numerals 131 and 132 denote lateral sealing portions. Furthermore, the encasement 100 includes an unshown backing portion in the central portion of the back face. Furthermore, the sealed encasement 100 stores unshown wet tissues folded in an appropriate manner.

A first U-shaped slit line 111 is formed in the upper face of the film 110 of the encasement 100 as shown in FIG. 1. The area enclosed within the U-shaped first slit line 111 provides an openable portion 150. The openable portion 150 allows the user to peel off and raise a lid member 200, thereby providing an opening. With such a structure, the lid member 200 having a tab 210 is adhered such that it covers the openable portion 150. Furthermore, an unshown adhesive layer is provided to the bottom face of the lid member 200, except for the tab 210. With such a structure, the lid member 200 is peelably adhered to the film 110 through the adhesive layer. The term "adhesive" as used here represents the state in which the lid member is adhered to the film in a manner that allows the user to peel the lid member away from the film and to reseal the encasement with the lid member. Also, according to the present invention, an arrangement may be made which has an opening formed by completely removing the corresponding sealing portion, instead of having the openable portion 150.

With the present embodiment, two parallel tearing guide devices 160 are provided in the upper face of the film 110 such that they extends from both ends of the U-shaped first slit line 111 up to the lateral sealing portion 131. In the drawings for describing the present embodiment, each tearing guide portion 160 is indicated by an imaginary line. In practice, each imaginary line extends along and corresponding to the direction in the drawing along which a drawn film, which is a material of the film 110, has been drawn. The orientation of the drawn film provides the tearing-guide portion 160.

In general, the encasement 100 is formed of a composite film having a layered structure in which a polyethylene terephthalate (PET) film, an aluminum foil, and a non-drawn heat-sealable polypropylene (CPP) film, are layered and adhered to one another in that order from the outer face side to which the lid member 200 is to be adhered.

Also, an arrangement may be made in which the outer face of the encasement 100 is formed of a uniaxial drawn PET film in order to improve the capability of the tearing guide portion 160 which allows the user to tear the film 110 along a straight line. Also, the first slit line may be provided in an annular shape. With such an arrangement, the aforementioned heat-sealable material may be easily peelable, thereby allowing the user to easily remove the portion surrounded by the first slit line so as to form an opening.

Lid Member

FIG. 2 is an enlarged view of a portion around the tab (the upper flap) 210 of the lid member 200. The lid member 200 is provided so as to be in contact with the encasement 100. The lid member 200 includes: a lid member main unit 220 having an adhesive layer formed by applying a pressure sensitive adhesive; and a tab 210 which is provided to the end of the lid member main unit 220 at 132 side such that it protrudes therefrom, and which serves as a starting point that allows the user to peel off the lid member 200. With such an arrangement, the pressure sensitive adhesive is not applied to the tab 210. Such an arrangement ensures that the lid member 200 is not entirely adhered to the encasement 100. Alternatively, the pressure sensitive adhesive may be applied to the tab 210 in a manner that provides a markedly small adhesive strength between the tab 210 and the encasement 100. Examples of methods for reducing the adhesive strength include a method of applying powder to the tab 210. On the other hand, a base end 230 is provided to the end of the lid member main unit 220 opposite to the tab 210 in the longitudinal direction, with sufficient adhesive strength to prevent it from peeling off undesirably.

The lid member 200 is formed of a flexible film or sheet. Examples of the aforementioned flexible films and sheets include a film having a layered structure in which a first sheet and a second sheet are layered. With such an example, a first layer has a single-layer structure formed of a polypropylene resin layer drawn along two axes, or a multi-layer structure in which a front layer is layered on the aforementioned polypropylene resin layer. On the other hand, the second sheet is formed of a polypropylene resin film or the like, which has a function as a cover sheet for protecting a printed layer formed on the surface of the first sheet.

Examples of the pressure sensitive adhesives which are applied so as to form an adhesive layer which is to be pressed into contact with the encasement 100 include: an acrylic adhesive; a polyvinyl chloride composition containing a plasticizer; and a material containing, as a principal component, a graftmer such as a graft polymer having a structure in which vinyl chloride monomer is graft-polymerized with ethylene-vinyl acetate copolymer.

Structure of Tab

The tab 210 includes: a second slit line 211 which allows the user to raise the tip of the tab 210 in a direction orthogonal to the direction along which the user can pull up the lid member 200; and hinge portions 212 which allow the user to easily maintain the tab in an upright position. Here, the second slit line 211 is a non-closed slit formed in a shape approximately like a letter "U", which opens in the direction of the tip of the tab 210. The second slit line 211 defines a part of the tab 210, thereby forming a tongue portion (in FIG. 2, a lower flap) 213, a region drawn round by the slit. With such a structure, the hinge portions 212 are formed such that they extend from both ends of the second slit line 211 toward the corresponding ends of the tab 210. Here, each hinge portion 212 is formed such that it extends along a direction approximately orthogonal to the direction in which the user can peel off the lid member 200 using the tab 210.

According to the present invention, each hinge portion 212 may be formed such that it meets the second slit line 211 at a desired position. Note that an arrangement should not be made in which the embossed line is formed within a portion defined by the U-shaped second slit line 211. The reason is as follows. Such an arrangement leads to an undesired folding of the tongue portion (lower flap) 213, which does not allow the user to raise the tongue portion 213. Such a structure cannot prevent the tab (upper flap) 210 from returning to its initial position, leading to a problem that the user cannot raise the tab 210. Furthermore, the tongue portion 213 is not formed as a so-called "tongue portion". Accordingly, the tab 210 does not provide the advantage of the so-called "tab portion" when the lid member 200 is peeled off.

Figure 5:
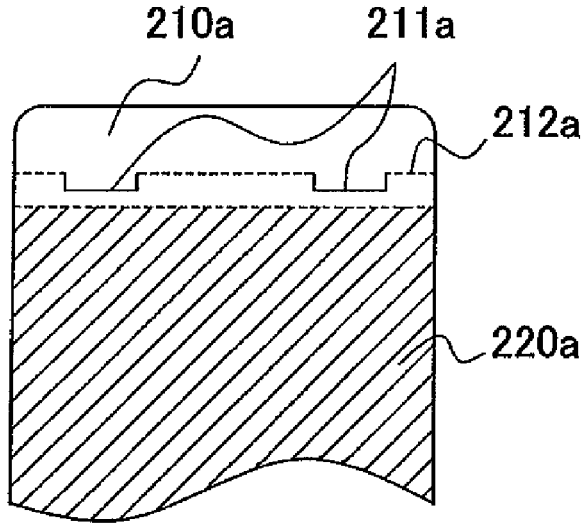
FIG. 5 is an enlarged view which shows a portion around a tab including another example of a second slit line.
Figure 6:
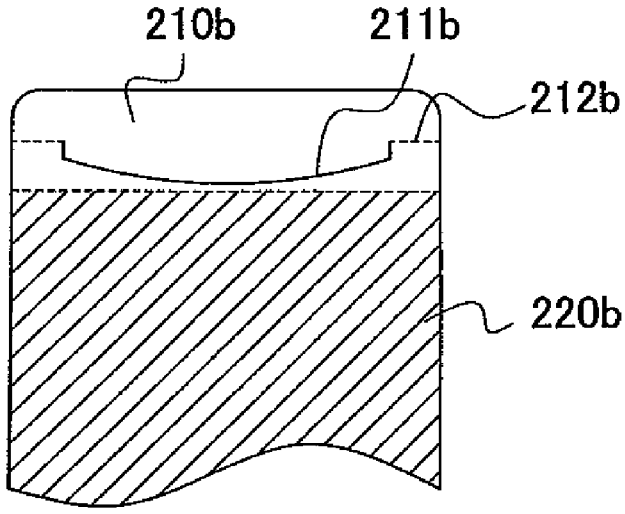
FIG. 6 is an enlarged view which shows a portion around a tab including yet another example of the second slit line.

Description has been made regarding an arrangement in which a single second slit line is formed in a shape of approximately like a letter "U". The size, the number, and the shape of the second slit lines are not restricted in particular as long as the second slit lines provide the tongue portion in a stable manner. FIGS. 5 and 6 show other examples of the second slit lines. FIG. 5 shows a lid member 200*a* having two second slit lines 211 formed in the shape of a letter "U". FIG. 6 shows a lid member 200*b* having a second slit line 211*b* formed in the shape of an arc. Such structures increase the overall area of the tongue portion, thereby improving the strength. This enables the user to repeatedly peel off and reseal the lid member without deterioration in the adhesive strength over a predetermined number of cycles.

The method for forming the hinge portion according to the present invention is not restricted in particular as long as a hinge portion is provided to a film in the form of a weak portion. The hinge portion may be provided in the form of a continuous line or a discontinuous line such as a perforated line. Also, the aforementioned weak line may be provided in the form of a slit tear line alone, a half-cut line alone, an embossed line alone, or various combinations thereof. The hinge portion according to the present invention means a structure which turnably connects two units along a predetermined line. Note that the second slit line 211 is not indispensable for the present invention. For example, an arrangement may be made in which only a single linear hinge portion (weak line) is provided so as to extend along a direction approximately orthogonal to the peeling direction for the tab 210.

Operation of Tab Portion

FIG. 3 is a perspective view which shows an easy-open encasement with the lid member 200 adhered to the encasement 100, after the tab (upper flap) 210 has been folded back along the hinge portion 212. As shown in FIG. 3, upon folding back the tab 210 along the hinge portion 212, the tongue portion (lower flap) 213 defined by the second slit line 211 protrudes from the tab 210. In this situation, the tongue portion 213 is folded back such that the top face of the lid member 200 comes into contact with the outer face of the encasement 100. Thus, such a structure allows the tab 210 of the lid member 200 to be maintained in a state in which it is elevated from both the lid member 200 and the encasement 100.

Description has been made with reference to FIG. 2 regarding an arrangement in which the second slit line 211 is formed in the tab 210. Also, an arrangement may be made in which a part of the second slit line 211 is formed in the lid member main unit 220. However, such an arrangement leads to a problem as follows. That is to say, upon the tab 210 being folded back for use as shown in FIG. 3, the tongue portion 213 thus exposed has a portion to which an adhesive has been applied. In some cases, this leads to a problem of dust or dirt becoming adhered to such a portion. Accordingly, the entire region of the second slit line 211 is preferably formed in the tab 210.

Also, such an arrangement allows the user to use the encasement with the tab 210 in a raised position, instead of completely folding back the tab 210. In this case, the tongue portion 213 serves as a support member for supporting the tab 210. Such an arrangement allows the tab 210 to be maintained in a state in which it is elevated from the encasement 100. This allows the user to easily hold the tab 210, thereby allowing the user to easily peel off the lid member 200 from the encasement 100.

Opening Operation and Example of Base End

FIG. 4 is a perspective view which shows the easy-open encasement after it has been opened. In a case of opening the encasement 100, the user holds the tongue portion 213 formed by folding back the tab 210 of the lid member 200 along the hinge portion 212, and peels off the lid member 200. With the present embodiment, the openable portion 150 is adhered to the lid member 200 by an adhesive applied to the bottom face of the lid member 200. Upon peeling off the lid member 200, the openable portion 150 of the film 110 is separated from the film 110 along the first slit line 111, and is elevated. Upon further peeling off the lid member 200, the film 110 tears along the tearing guide portions indicated by imaginary lines. In the final stage, the film 110 has been torn off up to the base end 230, thereby forming an annular opening 150 which allows the user to extract wet tissues.

With the present embodiment, the base end 230 is provided to the end of the lid member 200 opposite to the tab 210. The base end 230 serves as the end point up to which the film 110 is to be torn along the tearing-guide portions 160 with the first slit line 111 as a starting point, whereby the tearing ends at a predetermined point in a region covered by the lid member 200. Also, the base end 230 provides a function that allows the user to close the lid member 200 again for reuse as appropriate. The base end 230 is adhered to the film 110 through the adhesive layer in the same way as with the lid member main unit. The difference is that the base end 230 is adhered to the film 110 with sufficient adhesive strength to prevent the base end 230 from peeling away from the film 110, unlike the lid member main unit.

With the present embodiment, a U-shaped second slit line is formed. Such an arrangement provides a compact encasement having as large an opening as possible, which allows the user to extract wet tissues. This improves the ease-of-use in a simple manner. Note that the formation of the opening is not restricted in particular. Let us consider an arrangement in which an opening is formed with a uniform size. With such an arrangement, giving consideration to the margin of error in manufacturing, there is a need to form an opening with a smaller size, or to form an encasement with a larger size, than is the case with an arrangement in which the opening is provided in the form of a slit. Also, an arrangement may be made in which an opening is formed beforehand in an annular shape, and a label is adhered so as to cover the opening, as disclosed in Japanese Unexamined Utility Model Registration Application Publication No. 59-99974 and Japanese Unexamined Patent Application Publication No. 11-310281.

Figure 7:
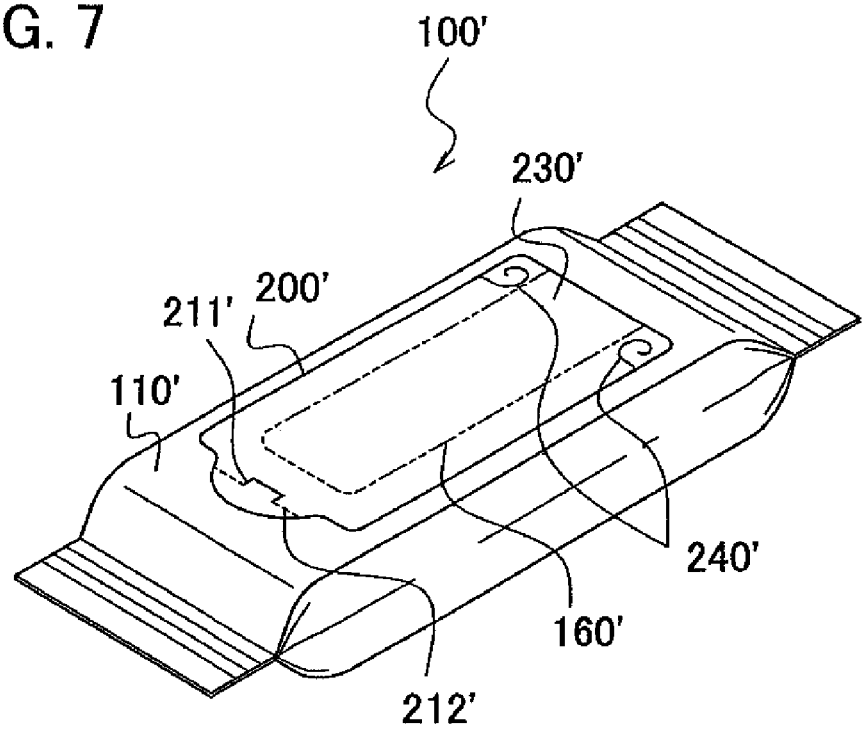
FIG. 7 is a perspective view which shows the encasement having another example of the base end.

FIG. 7 shows another example of the base end. A base end 230' of an encasement 100' shown in FIG. 7 further includes a third slit line 240' which is a curved line. With such an arrangement, upon the lid member 200 being peeled off to a certain length, the lid member 200 is separated from the encasement 100' along the third slit line 240', and the peeling off of the lid member 200 ends at the end point of the third slit line 240'.

Figure 8:
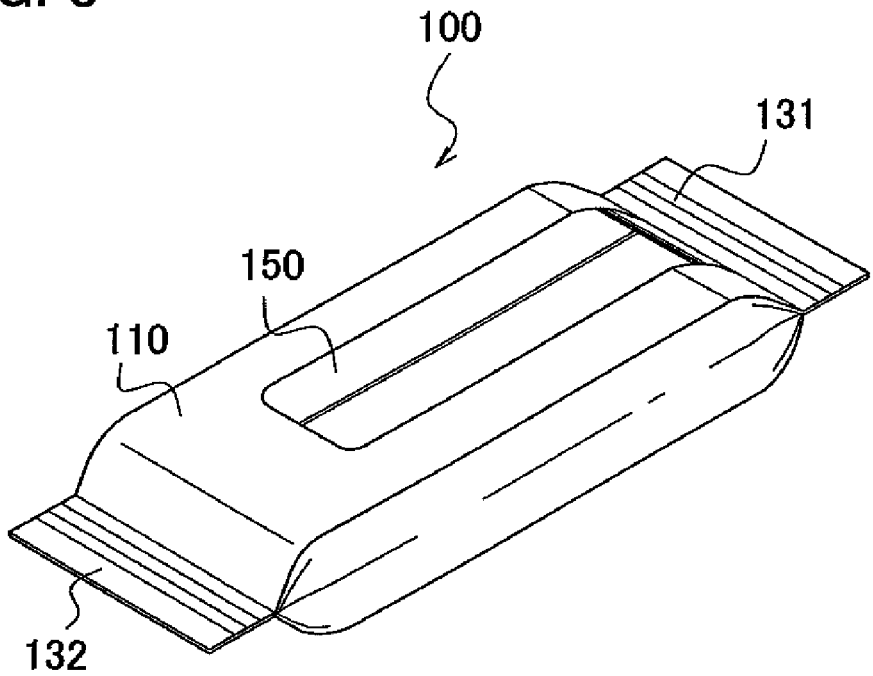
FIG. 8 is a perspective view which shows the lid member having been peeled off.

FIG. 8 is a perspective view which shows the encasement 100 after the lid member 200 has been peeled up to the lateral sealing portion. Such an encasement is used, in a case of giving a priority to the ease-of-use owing to a large opening, such as a case of a form in which the encasement is used in combination with an outer container that is currently commercially-available.

Figure 9:
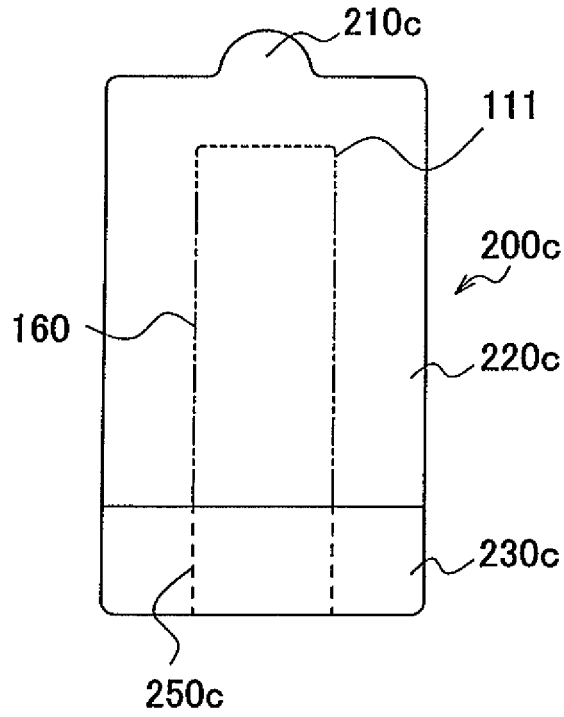
FIG. 9 is an enlarged view which shows another example of the lid member.

FIG. 9 is an enlarged diagram which shows an arrangement including the lid member and the first slit line. A single encasement having such a structure including a lid member 200*c* and the first slit line 111 allows the user to select a desired mode from among both usage modes as shown in FIGS. 4 and 8. With such an arrangement, the base end 230*c* of the lid member 200*c* includes a slit lines 250*c* parallel to the respective tearing-guide portions 160 formed in the encasement 100, which allows the user to easily separate the lid member 200. Such an arrangement provides two usage modes. That is to say, in a case of selecting a usage mode as shown in FIG. 4, which allows the user to easily reseal the encasement, the user peels off the lid member 200 up to the base end 230*c*. On the other hand, in a case of selecting a usage mode as shown in FIG. 8, i.e., in a case of using the encasement after the lid member 200 has been peeled off up to the lateral sealing portion, the user peels off the lid member 200 beyond the slit line 250*c* provided to the lid member 200, thereby forming an opening.

Figure 10:
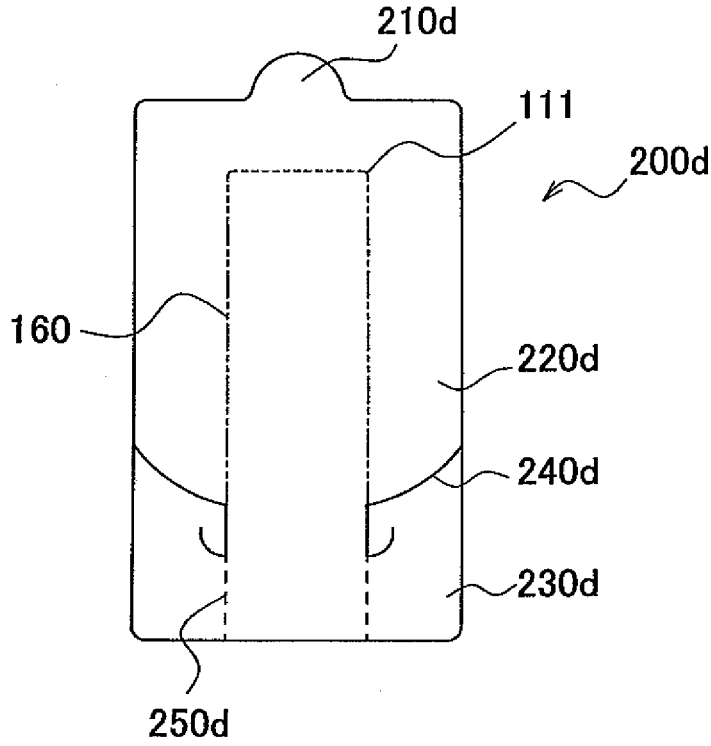
FIG. 10 is an enlarged view which shows yet another example of the lid member.

FIG. 10 is an enlarged diagram which shows another example of an arrangement including a lid member and a slit line. Such an arrangement further includes a slit line 250*d* near the third slit line 240*d*, in addition to the structure as shown in FIG. 7 in which the curved third slit line is provided to the base end 230, in the same way as described above. Such an arrangement provides the same advantage as that described with reference to FIG. 9.

Other Examples of Lid Member Tabs

Furthermore, the present invention allows the user to easily hold the tab using the fingers when the lid member is being peeled off, which is a main purpose of the present invention. FIGS. 11 through 19 are enlarged cross-sectional diagrams which show other examples of lid members.

Figure 11:
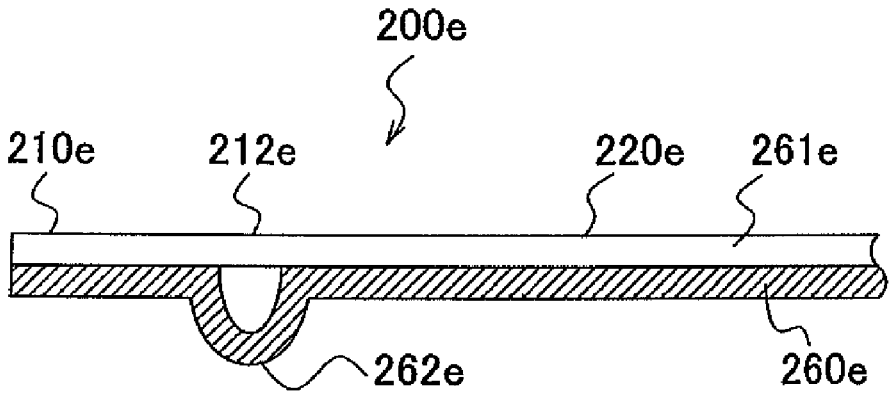
FIG. 11 is an enlarged cross-sectional view which shows the sheet structure of the lid member.

A lid member shown in FIG. 11 is formed of a first sheet 260*e* that serves as an inner face, and a second sheet 261*e* that serves as an outer face, with respect to the encasement 100. With such an arrangement, a part of the first sheet 260*e* is bent into a loop, thereby forming a loop portion 262, which allows the tab 210*e* to be easily elevated. At the portion where the loop portion 262*e* is formed, the second sheet 261*e* alone is free of the first sheet 260*e*. This allows the user to fold the tab 210*e* along such a looped portion. Furthermore, such an arrangement allows the tab 210*e* to be raised along the hinge portion 212*e*. With such an arrangement, the first sheet 260*e* and the second sheet 261*e* are connected to each other with the loop portion 262*e* formed in only the first sheet 260*e* being held by the second sheet 261*e*. The first sheet 260*e* and the second sheet 261*d* have been strongly connected with each other at the loop portion 262*e*. Accordingly, this prevents the loop portion 262*e* from returning to its initial state, thereby providing a mechanism for maintaining the loop portion 262*e* in this state. This allows the tab 210*e* to be maintained in an elevated state.

Figure 12:
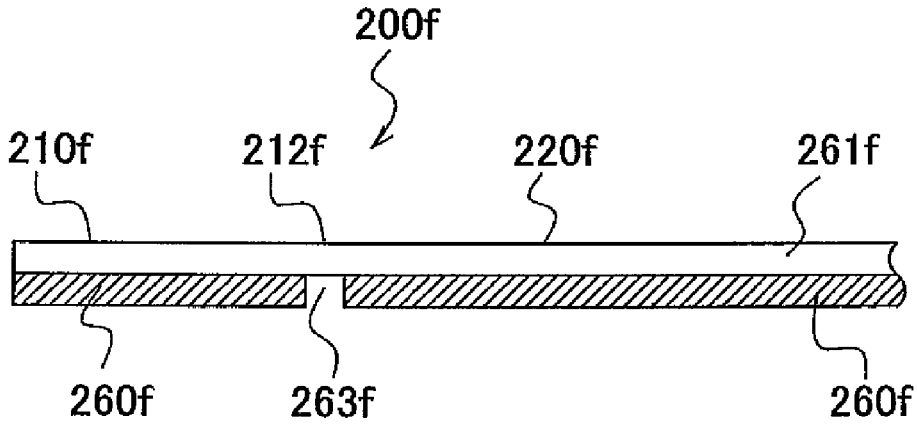
FIG. 12 is an enlarged cross-sectional view which shows another example of the sheet structure of the lid member.

FIG. 12 shows a lid member 200*f* having a structure in which a first sheet 260*f* is divided into a tab 210*f* and a lid member main unit 220*f* to which a pressure sensitive adhesive has been applied. With such an arrangement, there is a difference in the adhesive strength with a dividing portion 263*f* as a boundary. Such an arrangement provides a degree of freedom for the tab 210*a* with respect to the vertical direction. This allows the tab 210*a* to be maintained in a state in which it is elevated from the face of the encasement. Furthermore, the dividing portion 263*f* is formed of the second sheet 261*f* alone. Such a structure allows the user to easily fold and raise the tab 210*f* along the hinge portion 212*f*.

Figure 13:
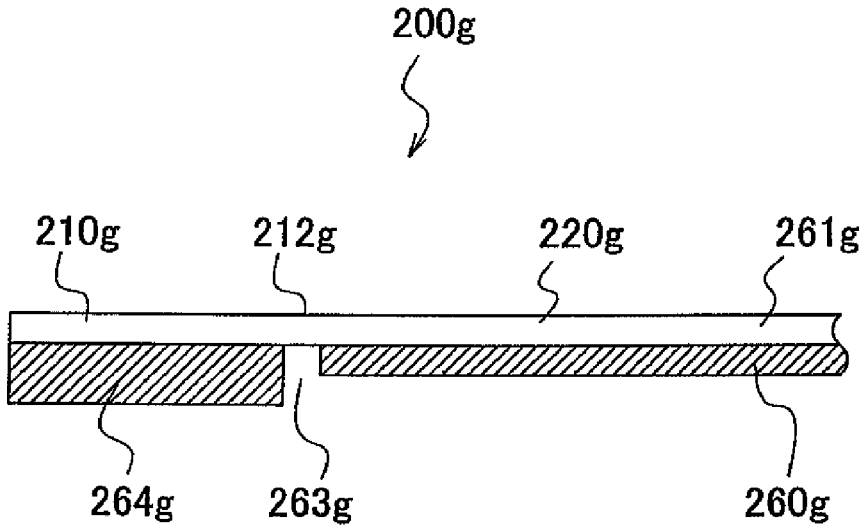
FIG. 13 is an enlarged cross-sectional view which shows yet another example of the sheet structure of the lid member.
Figure 14:
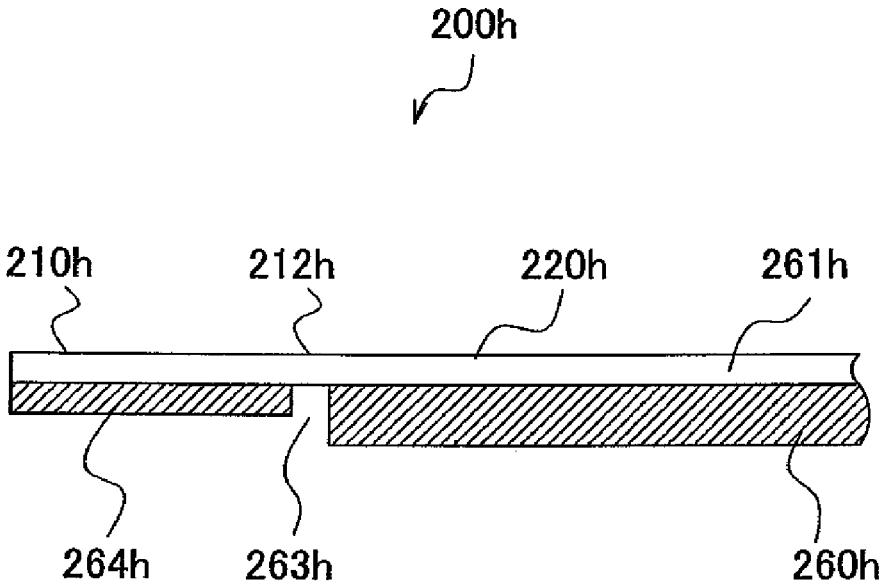
FIG. 14 is an enlarged cross-sectional view which shows yet another example of the sheet structure of the lid member.

FIGS. 13 and 14 show modifications of an arrangement shown in FIG. 12. With regard to such modifications, a third sheet, which is provided at a position corresponding to the tab such that it faces the encasement, is formed with a thickness that differs from that of the first sheet provided at a position corresponding to the lid member main unit. With such a structure of the lid member, the tab is elevated after the lid member is adhered to the encasement.

FIG. 13 shows a structure in which the thickness of a third sheet 264*g* provided at a position corresponding to the tab 210*g* is greater than that of a first sheet 260*g*. With such a structure, upon adhesion of the lid member to the encasement, the lid member is provided such that the tab 210*g* is elevated by an amount corresponding to a difference in the film thickness. On the other hand, FIG. 14 shows a structure in which the thickness of a third sheet 264*h* provided at a position corresponding to the tab 210*h* is smaller than that of a first sheet 260*h*. With such a structure, upon adhesion of the lid member to the encasement, the lid member is provided such that there is a space between the tab 210*h* and the encasement that corresponds to the difference in the film thickness. Furthermore, the modifications shown in FIGS. 13 and 14 have a structure in which the dividing portion between the first sheet and the third sheet is formed of the second sheet alone in the same way as that shown in FIG. 12. Such a structure allows the user to easily fold the lid member along the dividing portion. This allows the user to raise the tab along the hinge portion.

Figure 15:
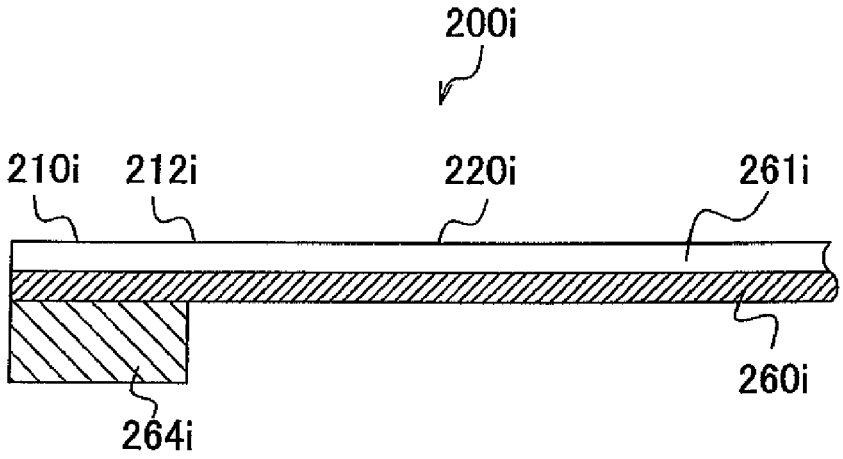
FIG. 15 is an enlarged cross-sectional view which shows yet another example of the sheet structure of the lid member.
Figure 16:
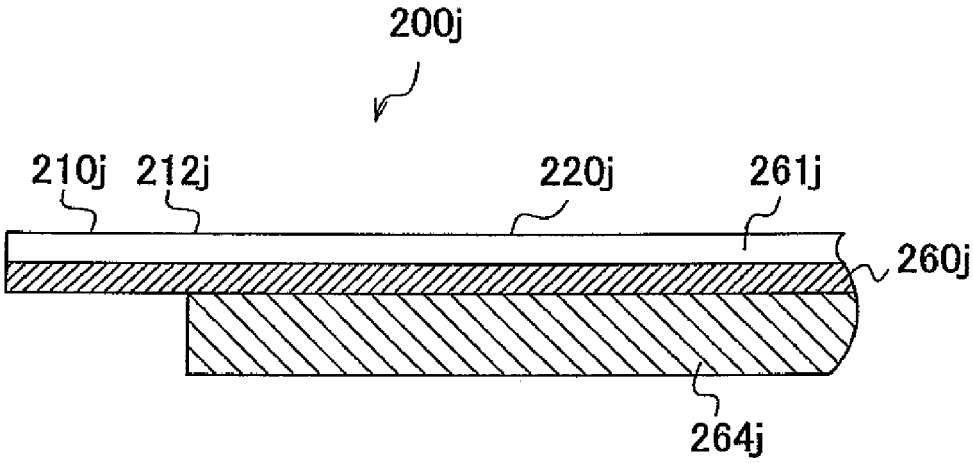
FIG. 16 is an enlarged cross-sectional view which shows yet another example of the sheet structure of the lid member.

FIGS. 15 and 16 show modifications of the modifications shown in FIGS. 13 and 14. FIG. 15 shows a structure in which a third sheet 264*i* is connected to the lid member 200*i* at a position corresponding to a tab 210*i*. With such a structure, upon adhesion of the lid member to the encasement, the lid member is provided such that the tab 210*i* is elevated by an amount that corresponds to the film thickness of the third sheet 264*i*.

FIG. 16 shows a structure in which a third sheet 264*j* is connected to the lid member 200*j* at a position corresponding to a lid member main unit 220*j*. With regard to such a structure, a pressure sensitive adhesive is applied to the face of the third sheet 264*j* which is to be adhered to the encasement. With such a structure, upon adhesion of the lid member to the encasement, the lid member is provided with a space between the tab 210*j* and the encasement by the film thickness of the third sheet 264*j*. With the modifications shown in FIGS. 15 and 16, there is a difference in the film thickness of the sheet between the tab and the lid member main unit. This allows the user to raise the tab along the hinge portion.

Figure 17:
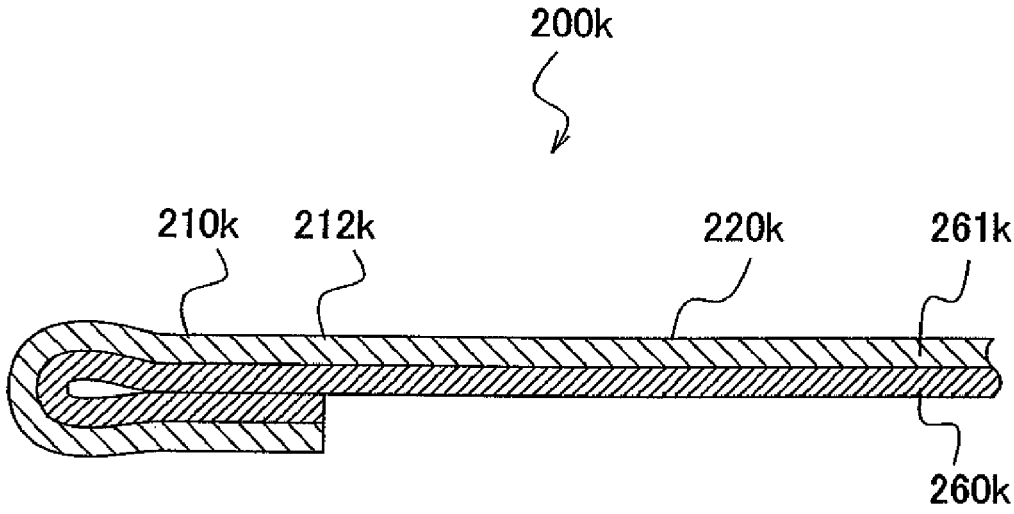
FIG. 17 is an enlarged cross-sectional view which shows yet another example of the sheet structure of the lid member.

FIG. 17 shows a structure in which a portion of a lid member 200*k* corresponding to a tab 210*k* is folded back upon itself, and the portions of a first sheet 260*k* that face each other are adhered to each other. With such a structure, the tab 210*k* is elevated from the surface of the encasement 100 by an amount that corresponds to the increase in the thickness that arise due to it being folded back upon itself. Furthermore, with such a structure, there is a difference in the film thickness between the tab 210*k* and a lid member main unit 220*k*. Such a structure allows the user to easily fold the lid member 200*k* along a hinge portion 212*k*, and to raise the tab 210*k*.

Figure 18:
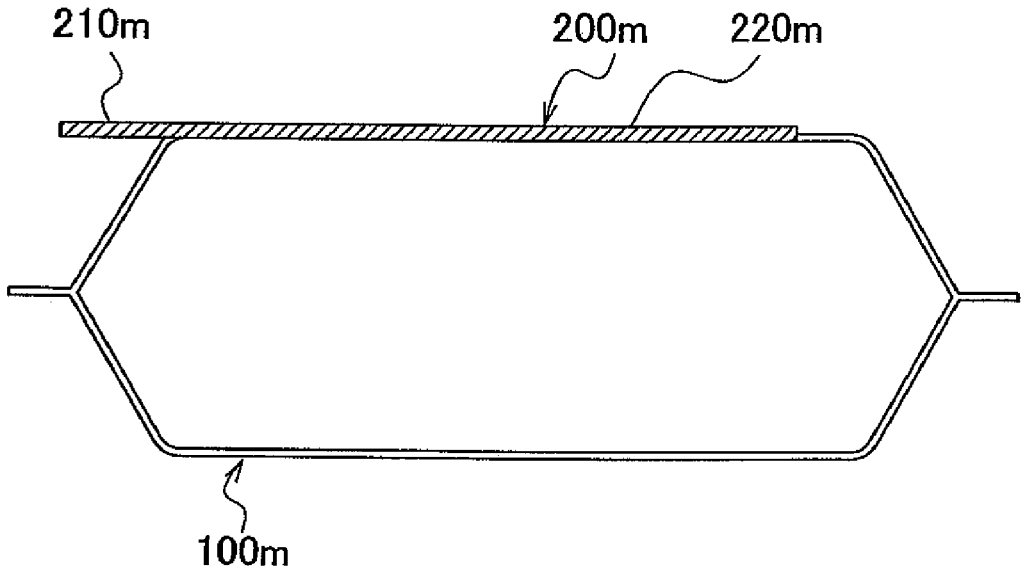
FIG. 18 is an enlarged cross-sectional view which shows another example of a structure in which the lid member is adhered to the encasement.

FIG. 18 shows an arrangement in which a lid member 200*m* is adhered to an encasement 100*m* with a part of, or the entire region of, a tab 210*m* of the lid member 200*m* protruding from the surface of the encasement 100*m*. With such an arrangement, the tab 210*m* is not placed on the face of the encasement 100*m*. Accordingly, in practice, the lid member 200*m* is provided to the encasement 100*m* with the tab 210*m* elevated from the surface of the encasement 100*m*.

Figure 19:
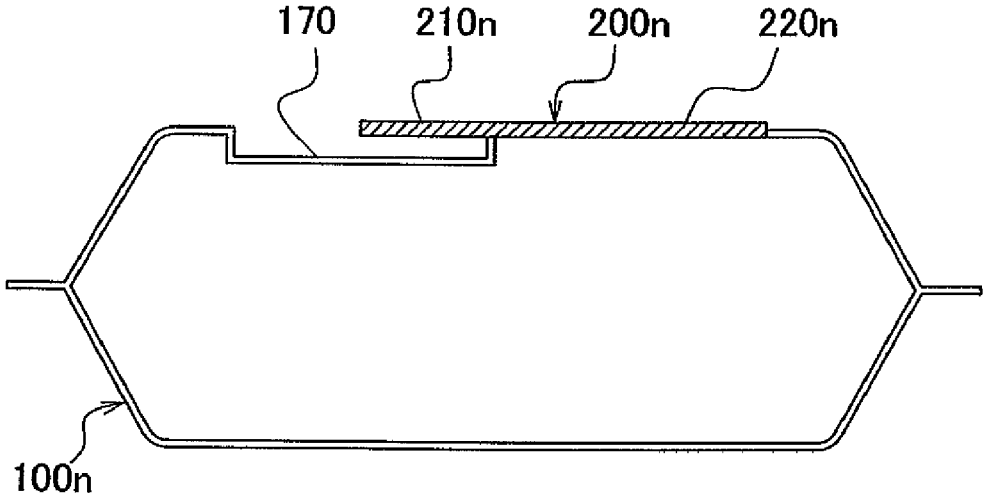
FIG. 19 is an enlarged cross-sectional view which shows yet another example of a structure in which the lid member is adhered to the encasement.

FIG. 19 shows an arrangement in which a recess 170 is formed in the face of an encasement 100*n* at a position corresponding to a tab 210*n* of a lid member 200*n*. With such an arrangement, the lid member 200*n* is provided such that there is a space between the tab 210*n* and the encasement 100*n* that corresponds to the depth of the recess 170. Here, the recess may be formed in an encasement film by embossing or the like. Such a recess can be easily formed in an encasement film formed of a material that has a high capacity to maintain its shape such as aluminum foil. Thus, the present embodiment is preferably applied to such an arrangement.

The second slit line provided to the tab of the lid member shown in FIGS. 18 and 19 is not restricted to a fully perforated slit line over the entire region. Also, the second slit line may be provided in the form of an embossed line or a perforated line as long as it allows the tab to be elevated to a certain level.

Double Encasement

Figure 22:
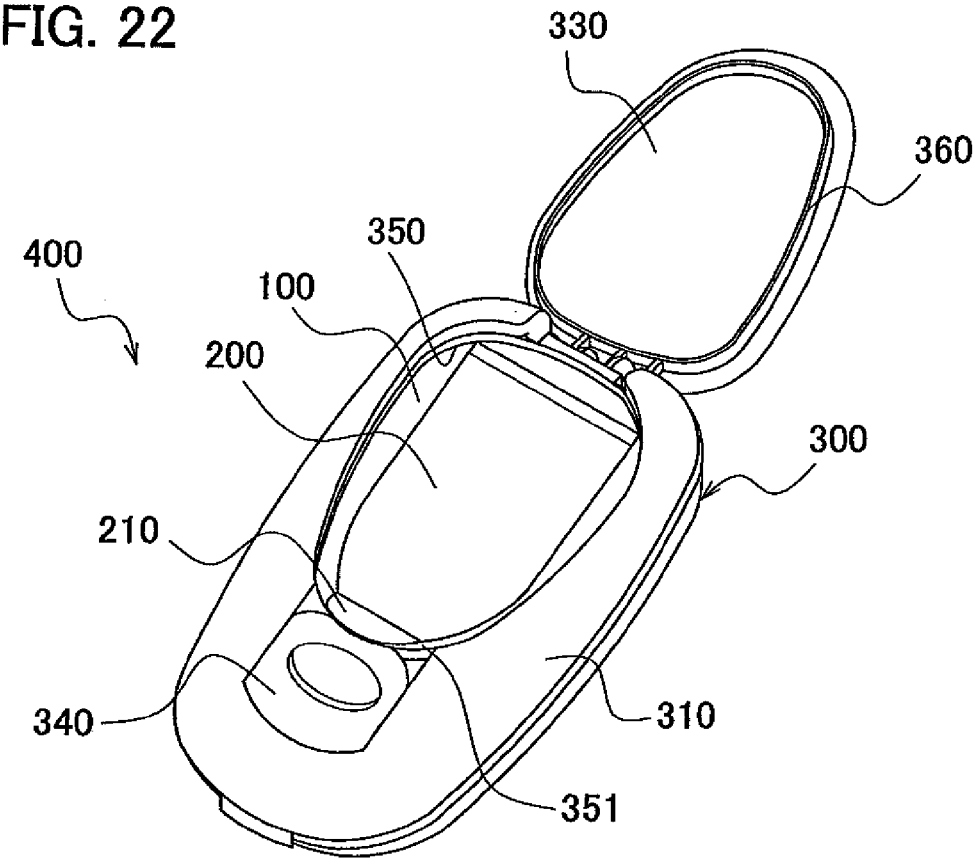
FIG. 22 is a perspective view which shows a state in which the encasement is being stored in the outer container with a cap portion being opened.
Figure 23:
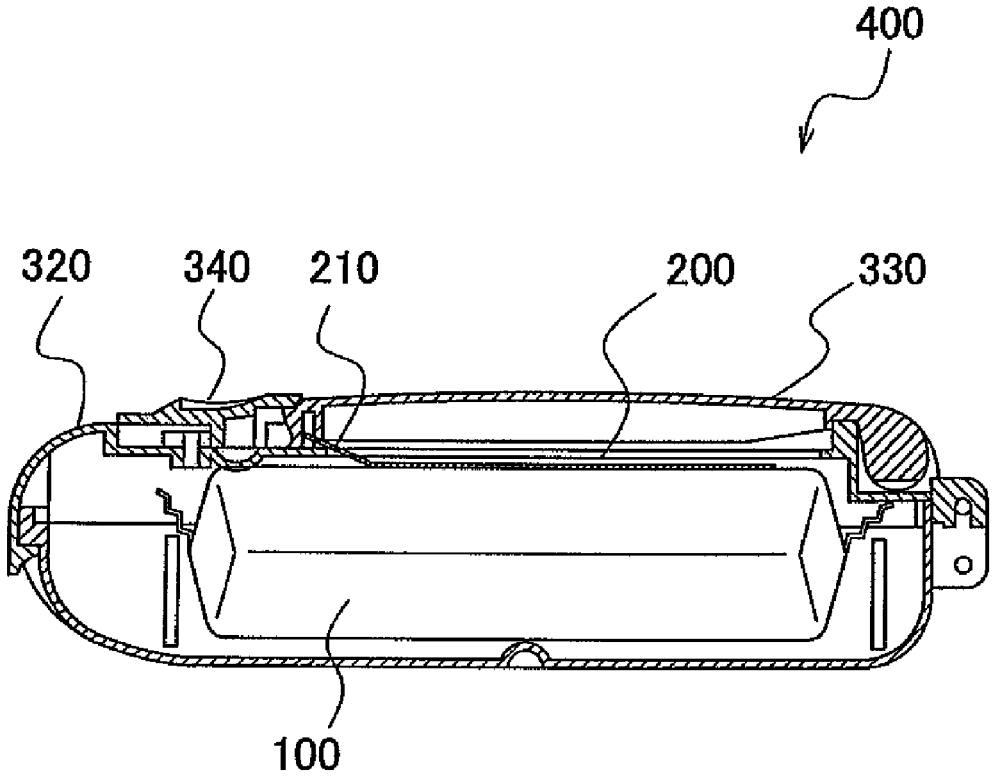
FIG. 23 is a cross-sectional view which shows the outer container storing the encasement.

The double encasement according to the present invention includes an easy-open encasement and an outer container 200. FIGS. 22 and 23 show the double encasement 400 in which the easy-open encasement 100 is set in the outer container 300.

Outer Container

Figure 20:
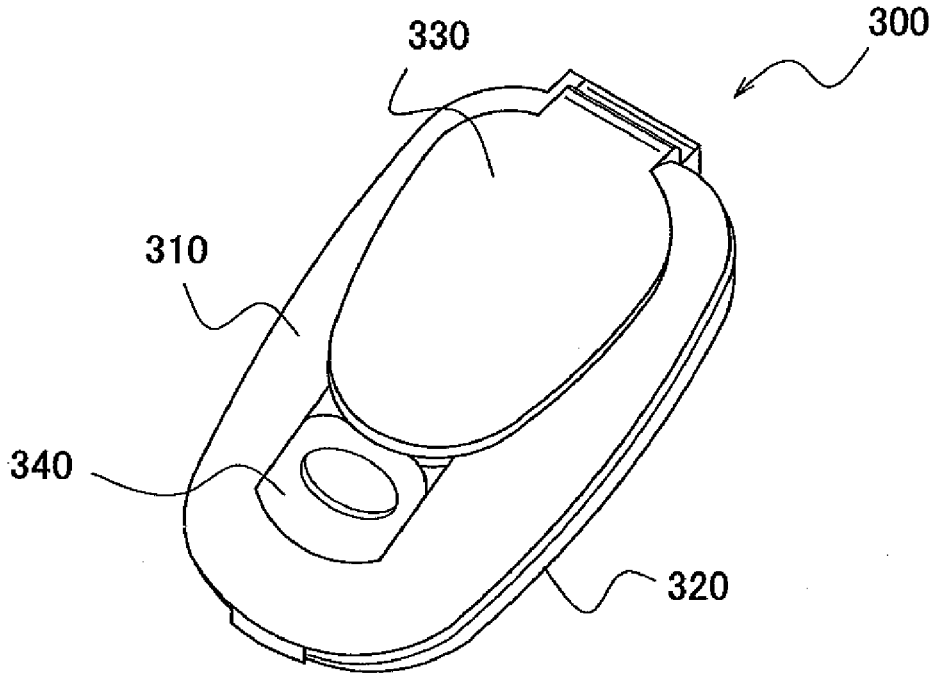
FIG. 20 is a perspective view which shows the schematic structure of an outer container.
Figure 21:
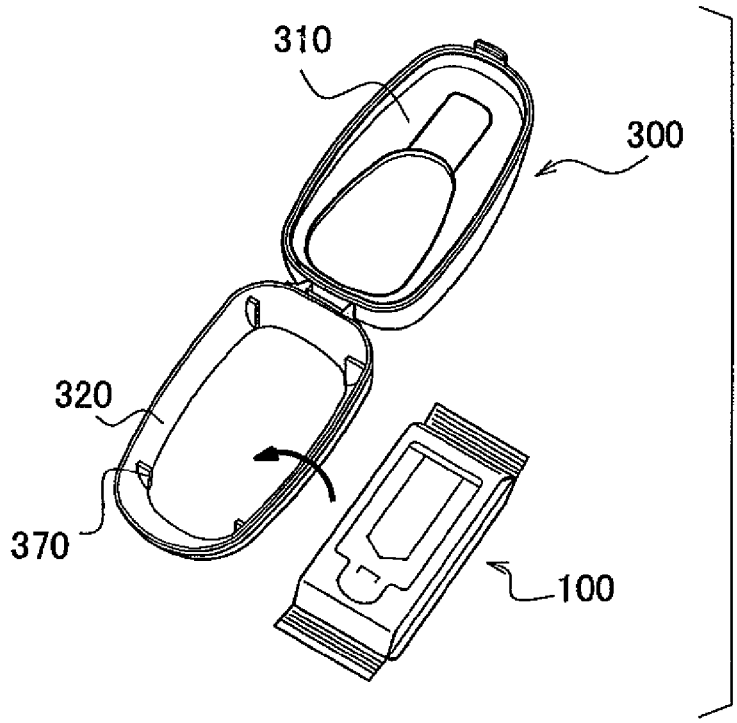
FIG. 21 is a schematic view which shows the encasement stored in the outer container.

The easy-open encasement according to the present invention may be used in a manner such that it is stored in an outer container. Such an arrangement provides superior airtightness, and accordingly it is preferably employed. FIGS. 20 through 23 are diagrams which show arrangements in which the encasement according to the present invention is used in a manner such that it is stored in an outer container. FIG. 20 is a perspective view which shows a schematic structure of the outer container. FIG. 21 is a schematic diagram which shows a state in which the encasement is being stored in the outer container. FIG. 22 is a perspective view which shows a state in which the encasement is being stored in the outer container with a cap portion being opened. FIG. 23 is a cross-sectional view which shows the outer container storing the encasement.

An outer container includes: a top lid 310; a bottom lid 320; a cap portion 330; and a button 340. Furthermore, an unshown metal spring is provided to an axial portion of the cap portion 330, which allows the cap portion 330 to be turned. Upon pulling down the button 340 in the direction away from the cap portion 330, the cap portion 330 is disengaged from the button 340, and the cap portion 330 is opened by the elastic force of the metal spring provided to the axial portion of the cap portion 330, whereby an exposed opening 350 formed in the top lid 310 is exposed.

The top lid 310 and the bottom lid 320 are opened before the encasement 100 is stored in the outer container 300. Here, the encasement 100 is held by ribs 370 provided to the bottom lid 320.

FIG. 22 is a diagram which shows a state in which the encasement 100 is stored in the outer container 300 with a cap portion 330 having been opened. With such an arrangement, the exposed opening 350 is provided beforehand to the top lid 310 of the outer container 300 in a form such that it is covered by the cap portion 330, which allows the user to extract sheets therefrom. The exposed opening 350 of the outer container 300 is formed with a predetermined depth that is sufficient for accommodate an annular ridge 360, which is a so-called inner ring, formed in the cap portion 330 in order to prevent wet tissues stored therein from drying during the state in which the cap portion 330 is closed. Furthermore, the ribs 370 provided to the bottom lib 320 provide the effects of a stopper. This allows such an arrangement to be used with the openable portion 150 of the encasement 100 matching the exposed opening 350 of the outer container 300.

FIG. 23 is a cross-sectional view which shows the outer container 300 storing the encasement 100. The encasement according to the present invention is stored in the outer container 300 with the tab 210 having been elevated. With the present embodiment, the tab 210 is placed at a level of the exposed opening 350. Such an arrangement provides an easy-open encasement structure which allows a consumer to easily peel off the lid member at the time of use. Also, an arrangement may be made in which a tongue portion formed by folding back the tab 210 is placed at a level of the exposed opening 350, which provides the same advantages as described above.

Description has been made with reference to FIG. 22 regarding an arrangement in which the tab 210 of the lid member 200 is provided at the perimeter of the exposed opening 350. The position at which the tab 210 is placed is not restricted in particular as long as such a configuration allows the user to hold the tab so as to be able to peel off the lid member. That is to say, the tab 210 should be placed such that it is exposed from the exposed opening.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. An encasement comprising:

an encasement member;

an opening or an openable portion formed in said encasement member;

a lid member peelably adhered to an upper surface of said encasement member and covering said opening or said openable portion;

wherein the lid member includes a tab adapted to be raised by a user to peel off said lid member; and a hinge portion located between the tab and a remainder of the lid member for the user to raise said tab, wherein said hinge portion is formed of a weak line on said lid member in a continuous or discontinuous manner, wherein the lid member includes a first sheet defining an inner surface of the lid member facing the upper surface of the encasement member, and a second sheet defining an outer surface of the lid member, wherein the first sheet on said hinge portion includes a structure having a thickness difference from that of a remainder of the first sheet.

2. The encasement according to claim 1, wherein said weak line comprises at least one of a slit tear line, a half-cut line, or an embossed line.

3. The encasement according to claim 1, wherein said hinge portion is provided around a base of said tab such that it extends along a direction approximately orthogonal to the direction along which said tab is to be raised, and wherein said hinge portion includes an approximately U-shaped slit tear line extending opposite to the direction along which said tab is to be raised, and said weak lines which extend from both ends of said approximately U-shaped slit tear line to the respective side edges of said tab.

4. The encasement according to claim 1, wherein said structure of the first sheet is a looped portion that is free of directly attachment to the second sheet of the hinge portion, so that the tab is adapted to be elevated by folding the tab along the looped portion.

5. The encasement according to claim 1, wherein said structure of the first sheet is a cut dividing the first sheet into two portions corresponding to the tab and the remainder of the lid member, respectively.

6. The encasement according to claim 5, wherein said two portions of the first sheet corresponding to the tab and the remainder of the lid member have different thicknesses.

7. The encasement according to claim 1, wherein said lid member further comprises a third sheet directly adhered to the first sheet at a portion corresponding to the tab or a portion corresponding to the remainder of the lid member and the third sheet has en edge defining the weak line.

8. The encasement according to claim 1, wherein the tab of the lid member has an end portion folded back and directly bonded to the first sheet.

9. The encasement according to claim 1, wherein the tab of the lid member protrudes, while remaining parallel to the upper surface of the encasement member, from the upper surface of the encasement member and said tab is free of direct contact to the encasement member.

10. The encasement according to claim 1, wherein the hinge portion includes a first weak line having a first end;

a second weak line having a second end opposite to the first end, wherein the first weak line extends from the first end away from the second weak line to a first side edge of the tab, the second weak line extends from the second end away from the first weak line to a second side edge of the tab, which the second side edge is opposite to the first side edge of the tab, and a slit tear line extending through an entire thickness of the lid member, said slit tear line projecting away from the tab and connecting the first and second ends of the first and second weak lines, respectively.

11. The encasement according to claim 10, wherein a tongue portion is defined by the slit tear line, and adapted to be folded downward toward the upper surface of the inner encasement when the tab is raised upward by the user.

12. A double-encasement comprising:

an inner encasement; and an outer container containing therein the inner encasement, wherein said inner encasement comprises:

an opening or an openable portion formed in said inner encasement;

a lid member peelably adhered to an upper surface of said inner encasement and covering said opening or said openable portion;

wherein the lid member includes a tab adapted to be raised by a user to peel off said lid member; and a hinge portion located between the tab and a remainder of the lid member for the user to raise said tab, said outer container comprises:

an exposed opening through which said lid member of said inner encasement is exposed and a cap portion for covering said exposed opening and adapted to be opened or closed by the user, and said tab of said lid member extends from within said outer container outwardly through the exposed opening, wherein said tab of said lid member rests on and directly contacts an edge of said exposed opening.

13. The double-encasement according to claim 12, wherein said hinge portion is formed of a weak line on said lid member in a continuous or discontinuous manner.

14. The double-encasement according to claim 12, wherein said weak line comprises at least one of a slit tear line, a half-cut line, or an embossed line.

15. A double-encasement comprising:

an inner encasement; and an outer container containing therein the inner encasement, wherein said inner encasement comprises:

an opening or an openable portion formed in said inner encasement;

a lid member peelably adhered to an upper surface of said inner encasement and covering said opening or said openable portion;

wherein the lid member includes a tab adapted to be raised by a user to peel off said lid member; and a hinge portion located between the tab and a remainder of the lid member for the user to raise said tab, said outer container comprises:

an exposed opening through which said lid member of said inner encasement is exposed; and a cap portion for covering said exposed opening and adapted to be opened or closed by the user, and said tab of said lid member extends from within said outer container outwardly through the exposed opening, wherein the hinge portion includes a first weak line having a first end;

a second weak line having a second end opposite to the first end, wherein the first weak line extends from the first end away from the second weak line to a first side edge of the tab, the second weak line extends from the second end away from the first weak line to a second side edge of the tab, which second side edge is opposite to the first side edge of the tab, and a slit tear line extending through an entire thickness of the lid member, said slit tear line projecting away from the tab and connecting the two opposite ends of the weak lines, wherein a tongue portion is defined by the slit tear line, and adapted to be folded downward toward the upper surface of the inner encasement when the tab is raised upward by the user.

16. The double-encasement according to claim 12, wherein the lid member includes a first sheet defining an inner surface of the lid member facing the upper surface of the inner encasement, and a second sheet defining an outer surface of the lid member, wherein the first sheet on said hinge portion includes a structure having a thickness different from that of a remainder of the first sheet.

* * * * *